US009255332B2

(12) United States Patent
McMillen et al.

(10) Patent No.: US 9,255,332 B2
(45) Date of Patent: Feb. 9, 2016

(54) ACTIVATING RINSE AND METHOD FOR TREATING A SUBSTRATE

(71) Applicant: PPG Industries Ohio, Inc., Cleveland, OH (US)

(72) Inventors: Mark W. McMillen, Cabot, PA (US); Nathan J. Silvernail, Allison Park, PA (US); Peter L. Votruba-Drzal, Pittsburgh, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 223 days.

(21) Appl. No.: 14/018,483

(22) Filed: Sep. 5, 2013

(65) Prior Publication Data

US 2015/0064445 A1 Mar. 5, 2015

(51) Int. Cl.
*C23C 22/78* (2006.01)
*C23C 22/03* (2006.01)

(52) U.S. Cl.
CPC ..... *C23C 22/78* (2013.01); *C23C 22/03* (2013.01)

(58) Field of Classification Search
None
See application file for complete search history.

(56) References Cited

U.S. PATENT DOCUMENTS

| | | | | |
|---|---|---|---|---|
| 3,625,777 | A | 12/1971 | Okabe et al. | |
| 6,214,132 | B1 | 4/2001 | Nakayama et al. | |
| 6,478,860 | B1 | 11/2002 | Nakayama et al. | |
| 6,723,178 | B1 | 4/2004 | Bannai et al. | |
| 7,208,054 | B2 | 4/2007 | Nakazawa | |
| 2005/0187326 | A1 * | 8/2005 | Nakazawa | 524/417 |

FOREIGN PATENT DOCUMENTS

| | | | |
|---|---|---|---|
| EP | 1378586 | A1 | 1/2004 |
| EP | 1566466 | A1 | 8/2005 |
| EP | 1959031 | A1 | 8/2008 |

* cited by examiner

*Primary Examiner* — Sheeba Ahmed
(74) *Attorney, Agent, or Firm* — Alicia M. Passerin, Esq.

(57) ABSTRACT

An activating rinse for treating a substrate is disclosed. The activating rinse comprises a first component comprising a dispersion of divalent or trivalent metal phosphate particles having an average particle size that is not greater than 10 μm, and a second component comprising first and second copolymers. The first copolymer is formed by the polymerization of ethylene oxide, propylene oxide, or combinations thereof, wherein one end of the first copolymer is terminated by an amine group, a hydroxyl group, or an alkyl group. The second copolymer is formed by the polymerization of styrene and a second monomer containing at least one carboxylate group, anhydride group, or combinations thereof. The second monomer is present in an amount of less than 50 percent by weight of the total weight of the second component. Also disclosed are methods for treating a substrate with the activating rinse and substrates treated with the activating rinse.

20 Claims, No Drawings

ACTIVATING RINSE AND METHOD FOR TREATING A SUBSTRATE

FIELD OF THE INVENTION

An activating rinse for treating a substrate is disclosed.

BACKGROUND

Phosphate conversion coatings are well known for treating metal surfaces, particularly ferrous, zinc and aluminum metals and their alloys. When applied, these phosphate coatings form a phosphate layer, primarily of zinc and iron phosphate crystals, which provides corrosion resistance and/or enhances the adhesion of subsequently applied coatings.

Prior to application of the phosphate coating, the metal substrate is typically "conditioned" or "activated" by subjecting the surface of the metal substrate to a diluted aqueous dispersion, sometimes referred to as an activating rinse or activator, by introducing or immersing the metal substrate into a tank that contains the activating rinse bath. "Activation" of the surface of the metal substrate is achieved due to the adsorption of colloidal titanium-phosphate particles, which are present in the activating rinse bath, to the metal's surface. These colloidal titanium-phosphate particles, however, have a tendency to agglomerate in the activating rinse bath due to dissolved calcium ($Ca^{2+}$) and magnesium ($Mg^{2+}$) ions (hard water ions) that are typically present in the rinse conditioner bath.

Zinc phosphate and other divalent metal phosphate dispersions also may be used to "activate" the surface of the metal substrate, but such dispersions are generally unstable.

SUMMARY

An activating rinse for treating a substrate is disclosed. In an embodiment, the activating rinse comprises:

(a) a first component comprising a dispersion of phosphate particles of divalent or trivalent metals or combinations thereof, said metal phosphate particles having an average particle size that is not greater than 10 μm; and (b) a second component comprising:

(i) a first copolymer formed by the polymerization of ethylene oxide, propylene oxide, or combinations thereof, wherein one end of the first copolymer is terminated by an amine group, a hydroxyl group, or an alkyl group; and (ii) a second copolymer formed by the polymerization of styrene and a second monomer containing at least one carboxylate group, anhydride group, or combinations thereof, wherein the second monomer is present in an amount of less than 50 percent by weight of the total weight of the second component.

Also disclosed is a method for treating a substrate. In an embodiment, the method comprises: (i) applying an activating rinse to at least a portion of the substrate, wherein the activating rinse comprises:

(a) a first component comprising a dispersion of phosphate particles of divalent or trivalent metals or combinations thereof, said metal phosphate particles having an average particle size that is not greater than 10 μm; and (b) a second component comprising:

(i) a first copolymer formed by the polymerization of ethylene oxide, propylene oxide, or combinations thereof, wherein one end of the first copolymer is terminated by an amine group, a hydroxyl group, or an alkyl group; and (ii) a second copolymer formed by the polymerization of styrene and a second monomer containing at least one carboxylate group, anhydride group, or combinations thereof, wherein the second monomer is present in an amount of less than 50 percent by weight of the total weight of the second component.

In an embodiment, a substrate treated with the activating rinse is also disclosed.

DETAILED DESCRIPTION

As used herein, unless otherwise expressly specified, all numbers such as those expressing values, ranges, amounts or percentages may be read as if prefaced by the word "about", even if the term does not expressly appear. It is also understood that a plural term can encompass its singular counterpart and vice versa.

When referring to any numerical range of values, such ranges are understood to include each and every number and/or fraction between the stated range minimum and maximum.

As used herein, the phrase "activating rinse" will refer to an aqueous solution and/or a colloidal suspension or dispersion that is applied onto at least a portion of a substrate and/or into which at least a portion of a substrate is immersed in order to promote the formation of a zinc phosphate coating on at least a portion of the substrate that was treated with the activating rinse. It is therefore understood that the substrate is treated with the activating rinse prior to phosphatizing at least a portion of the treated substrate with a zinc phosphate solution.

As used herein, the term "vehicle" or variations thereof includes, but is not limited, to civilian, commercial, and military land vehicles such as cars and trucks.

The present invention is directed to an activating rinse that is utilized to "activate" or "condition" at least a portion of a substrate prior to phosphatizing at least a portion of a substrate with a zinc phosphate solution. In other words, the activating rinse promotes the formation of zinc and zinc/iron phosphate crystals on the substrate when at least a portion of the substrate, which was subjected to the activating rinse, is phosphatized with a zinc phosphate solution. Non-limiting examples of a suitable substrate that can be treated with the activating rinse include, but are not limited to, a metal and/or a metal alloy. For example, the metal and/or metal alloy can be aluminum, steel, or zinc. In one embodiment, a steel substrate could include cold rolled steel, electrogalvanized steel, and hot dipped galvanized steel. In one embodiment, the substrate may comprise a portion of a vehicle such as a vehicular body (e.g., without limitation, door, body panel, trunk deck lid, roof panel, hood, and/or roof) and/or a vehicular frame.

In an embodiment, an activating rinse for treating a substrate is disclosed. In an embodiment, the activating rinse comprises (a) a first component comprising a dispersion of phosphate particles of divalent or trivalent metals or combinations thereof, said metal phosphate particles having an average particle size that is not greater than 10 μm; and (b) a second component comprising: (i) a first copolymer formed by the polymerization of ethylene oxide, propylene oxide, or combinations thereof, wherein one end of the first copolymer is terminated by an amine group, a hydroxyl group, or an alkyl group; and (ii) a second copolymer formed by the polymerization of styrene and a second monomer containing at least one carboxylate group, anhydride group, or combinations thereof, wherein the second monomer is present in an amount of less than 50 percent by weight of the total weight of the second component.

In an embodiment, (a) the first component comprises a dispersion of phosphate particles of divalent or trivalent metals or combinations thereof, the metal phosphate particles having an average particle size that is not greater than 10 μm, such as from 0.06 μm to 8 μm, such as from 0.1 μm to 5 μm.

In an embodiment, particle size may be measured using an instrument such as the Mastersizer 2000, available from Malvern Instruments, Ltd., of Malvern, Worcestershire, UK, or an equivalent instrument. The Mastersizer 2000 directs a laser beam through a dispersion of particles, and measures the light scattering of the dispersion. The amount of dispersion is inversely proportional to the particle size. A series of detectors measure the scattered light and the data are then analyzed by computer software to generate a particle size distribution, from which average particle size can be routinely determined.

In an embodiment, the metal phosphate may be present in the activating rinse in an amount ranging from 50 to 5,000 ppm of total metal phosphate based on the total weight of the activating rinse. In another embodiment, the metal phosphate may be present in the rinse conditioner composition in an amount ranging from 150 to 1,500 ppm of total metal phosphate based on the total weight of the activating rinse.

In an embodiment, the divalent or trivalent metals may be zinc, iron, calcium, manganese, aluminum, or combinations thereof.

Suitable zinc phosphates useful in the rinse conditioner bath include, without limitation $Zn_3(PO_4)_2$, $Zn_2Fe(PO_4)_2$, $Zn_2Ca(PO_4)_2$, $Zn_2Mn(PO_4)_2$, or combinations thereof.

Suitable iron phosphates useful in the rinse conditioner bath include, without limitation $FePO_4$, $Fe_3(PO_4)_2$, or combinations thereof.

Suitable calcium phosphates useful in the rinse conditioner bath include, without limitation $CaHPO_4$, $Ca_3(PO_4)_2$, or combinations thereof.

Suitable manganese phosphates useful in the rinse conditioner bath include, without limitation $Mn_3(PO_4)_2$, $MnPO_4$, or combinations thereof.

Suitable aluminum phosphates useful in the rinse conditioner bath include, without limitation $AlPO_4$.

In an embodiment, (b) the second component comprises (i) a first copolymer and (ii) a second copolymer. In an embodiment, at least some of (i) first copolymer and (ii) second copolymer may be polymerized. In an embodiment, (i) first copolymer may be present in excess.

In an embodiment, the weight ratio of component (a) to component (b) may be from 1:1 to 20:1, such as from 2:1 to 10:1, such as from 4:1 to 5:1.

As mentioned above, in an embodiment, (i) the first copolymer may be formed by the polymerization of ethylene oxide, propylene oxide, or combinations thereof, wherein one end of the first copolymer may be terminated by an amine group, a hydroxyl group, or an alkyl group, such as, for example, the Jeffamine M series, available from Huntsman Corporation. In an embodiment, (i) the first copolymer may be formed by the polymerization of monomers comprising structure (I):

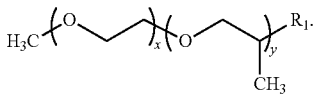

(I)

In embodiments, $R_1$ may be $NH_2$ or $OR_2$, $R_2$ may be hydrogen, a methyl group, or an ethyl group, and $x \geq 0$ and $y > 0$.

In an embodiment, (i) the first copolymer may be present in the activating rinse in an amount ranging from 10 ppm to 10,000 ppm based on the total weight of the second compound, such as from 25 to 1,000 ppm, such as from 50 to 200 ppm.

As mentioned above, in an embodiment, (ii) the second copolymer may be formed by the polymerization of styrene and a second monomer containing at least one carboxylate group, anhydride group, or combinations thereof. In an embodiment, the monomer may be a monoacid such as (meth)acrylic acid, a diacid such as maleic acid or itaconic acid, an acid anhydride such as acrylic anhydride or maleic anydride, or combinations thereof, such as, for example, dispersing agents such as Zetasperse 3100 available from Air Products Chemicals Inc. or Disperbyk-190 available from BYK-Chemie GmbH.

In an embodiment, (ii) the second copolymer may be present in an amount of less than 50 percent by weight of the total weight of the second component, such as less than 25%, such as less than 10. In an embodiment, (ii) the second copolymer may be present in an amount of greater than 0%, such as greater than 2%.

In an embodiment, the activating rinse may further comprise silica. In an embodiment, the silica may be a precipitated silica. In an embodiment, the silica may be friable under shear. In an embodiment, the silica may comprise 160 EZ silica. In an embodiment, the silica may be present in an amount of from 50 ppm to 5000 ppm based on the total weight of the activating rinse, such as from 100 ppm to 1,000 ppm, such as from 150-500 ppm.

The activating rinse may optionally further comprise additional components such as nonionic surfactants and auxiliaries conventionally used in the art of pretreatment. In an aqueous medium, water dispersible organic solvents, for example, alcohols with up to about 8 carbon atoms such as methanol, isopropanol, and the like, may be present; or glycol ethers such as the monoalkyl ethers of ethylene glycol, diethylene glycol, or propylene glycol, and the like. When present, water dispersible organic solvents typically may be used in amounts up to about ten percent by volume, based on the total volume of aqueous medium.

Other optional components include surfactants that function as defoamers or substrate wetting agents. Anionic, cationic, amphoteric, and/or nonionic surfactants may be used. Defoaming surfactants are often present at levels up to 1 weight percent, such as up to 0.1 percent by weight, and wetting agents are typically present at levels up to 2 percent, such as up to 0.5 percent by weight, based on the total weight of the rinse conditioner bath.

In certain embodiments, the activating rinse bath may further comprise a rheology modifier. In embodiments, the rheology modifier may comprise, for example, polyurethanes, acrylic polymers, latex, styrene/butadiene, polyvinylalcohol, clays such as attapulgite, bentonite, and other montmorillonite, cellulose based materials such as Carboxymethyl cellulose, methyl cellulose, (hydroxypropyl)methyl cellulose or gelatin, gums such as guar and xanthan, silicas such as colloidal and fumed silica, or combinations thereof.

In certain embodiments, the activating rinse may be substantially or, in some cases, completely, free of titanium-phosphate particles. As used herein, the term "substantially free," when used in reference to the absence of titanium-phosphate particles in the activating rinse, means that any titanium-phosphate particles are present in the activating rinse in a trace amount of less than 5 ppm. As used herein, the term "completely free," when used in reference to the absence of titanium-phosphate particles, means that there are no titanium-phosphate particles at all.

In one embodiment, the activating rinse concentrate may be prepared by charging (a) first component and (b) second component in a mixing vessel and mixing the components using dispersion methods familiar to those skilled in the art. Such methods may include charging the high-speed and high shear mixing equipment, horizontal or vertical media mills, ball mills, or pot mills.

The activating rinse bath can be prepared by introducing the activating rinse concentrate to an aqueous medium such as water. In an embodiment, the activating rinse bath may comprise a chelator. In embodiments, the chelator may comprise, for example, carboxylates such as tartrate, citrate or gluconate, acetate based complexes such as ethylene diamine tetra acetate or nitrilo triacetate, phosphates such as sodium triphosphate or tetra potassium pyro-phosphate, phosphonates or phosphone acids, poly-carboxylates such as oxalic acid, the acids or salts of any of the aforementioned, or combinations thereof.

In accordance with a method of the present invention, a substrate is treated by (a) applying an activating rinse described above to at least a portion of the substrate, and (b) phosphatizing at least a portion the substrate with an aqueous zinc phosphate solution. In one embodiment, the activating rinse can be applied to the substrate by spray, roll-coating or immersion techniques. The activating rinse is typically applied onto the substrate at a temperature ranging from 20° C. to 50° C. for any suitable period of time. After the surface of the substrate has been "activated", the surface of the substrate is subjected to a phosphate pretreatment such as a zinc phosphate pretreatment. In embodiments, the phosphatizing step can be performed by spray application or immersion of the activated substrate in an acidic phosphate bath which contains zinc and other divalent metals known in the art at a temperature ranging from 35° C. to 75° C. for 1 to 3 minutes. After phosphatizing, the substrate may be optionally post-rinsed with a chromium or non-chromium containing solution, rinsed with water and optionally dried. Paint is then typically applied, such as, by electrodeposition or by conventional spray or roll coating techniques.

The present invention is also directed to an activating stage such as those used in an automotive manufacturing facility. In one embodiment, the activating stage comprises an immersion tank which contains the activating rinse that is disclosed herein. In one embodiment, the activating rinse is contained within the immersion tank at a temperature ranging from 20° C. to 50° C. A portion of the substrate is subjected to the activating rinse by immersing the substrate in the activating rinse for any suitable period of time. After being immersed in the activating rinse, a portion of the "activated" substrate then may be subjected to a phosphatizing step by applying a zinc phosphate solution to the "activated" substrate. It should be noted, however, that prior to the application of the phosphate solution to the "activated" substrate, additional activating rinse can be sprayed onto a portion of the "activated" substrate via a spraying nozzle as the "activated" substrate is removed from the immersion tank. For example, the spraying nozzle could be an "exit halo" which is positioned downstream from the immersion tank. After the "activated" substrate exits the immersion tank and/or after additional activating rinse is applied onto the "activated" substrate, the "activated" substrate is phosphatized by applying a zinc phosphate solution to the "activated" substrate using techniques that are known in the art such as a spray and/or an immersion technique.

In another embodiment, the "activating" stage comprises a number of spraying nozzles that are used to apply the activating rinse bath onto a least a portion of a substrate. Disposed beneath the spraying nozzles is a spray tank which is adapted to collect the activating rinse that exits the spraying nozzles and/or any excess activating rinse that drips off the surface of the "activated" substrate. The spray tank is connected to the spraying nozzles in a manner that allows the spraying nozzles to utilize the activating rinse that is collected in the spray tank thereby recycling the activating rinse bath. After the activating rinse is applied onto at least a portion of the substrate, the "activated" substrate is then phosphatized as described in the preceding paragraph.

EXAMPLES

A phosphate activator based on zinc phosphate (Dispersion A) was prepared as follows:

The following materials were charged into a mixing vessel in order and dispersed with a Cowles blade until homogenous:

| | |
|---|---|
| Deionized water | 21.49 lbs |
| Ethylene glycol monobutyl ether | 0.41 lbs |
| Proprietary anionic grind vehicle | 5.16 lbs |
| Diisopropanolamine, 85% | 2.23 lbs |
| Surfynol DF-110D | 0.35 lbs |
| Nubirox SP Zinc Phosphate | 41.25 lbs |

The dispersion was mixed for an additional hour, then milled in a Premier horizontal mill with 1.2-1.7 mm Zirconox grind media for a total of 217 minutes (residence time 8.5 minutes). The resultant dispersion had a theoretical zinc phosphate content of 58.2% by weight.

A silica dispersion (Dispersion B) was prepared as follows:

300 g of Hi-Sil 160 precipitated silica, available from PPG Industries, was mixed into 900 g of deionized water with a Cowles blade. Mixing was continued for an additional ten minutes, and then the mixture was charged into a vertical mill having a triple-bladed impeller, along with 1,200 g of 1.6-2.5 mm zircoa grind media. The mixture was milled for 45 minutes. The resultant dispersion had a theoretical silica content of 25% by weight.

A phosphate activator based on zinc phosphate and using a dispersant comprised of ethylene oxide and styrene/acrylate copolymers (Dispersion C) was prepared as follows:

The following materials were charged into a mixing vessel in order and dispersed with a Cowles blade until homogeneous:

| | |
|---|---|
| Deionized water | 1,113.40 grams |
| Surfynol DF-110D | 19.00 grams |
| Zetasperse 3100 | 638.40 grams |
| Nubirox SP Zinc Phosphate | 2,029.20 grams |

Zetasperse 3100 is a dispersant comprised of ethylene oxide and styrene/acrylate copolymers, available from Air Products and Chemicals, Inc. Surfynol DF-110D is a proprietary defoamer available from Air Products and Chemicals, Inc.

After mixing thoroughly, the dispersion was milled in an Eiger horizontal mill with 1.2-1.7 mm Zirconox grind media for a total of 190 minutes (residence time 12 minutes). The resultant dispersion had a theoretical zinc phosphate concentration of 53.40% by weight.

A zinc phosphate bath, Chemfos 700AL, was prepared according to the technical data sheet from the supplier, PPG Industries (incorporated herein by reference). The zinc phosphate bath was used to produce phosphated steel panels using the following process sequence (hereafter referred to as the "standard zinc phosphating process"):

Clean, Chemkleen 2010LP (1.25% v/v)/Chemkleen 181ALP (0.125%), two minute spray at 120° F.;
DI immersion rinse, 15 seconds, ambient temperature;
DI spray rinse, 15 seconds, ambient temperature;
Activator, 1 minute immersion, ambient temperature;
Chemfos 700AL, 2 minute immersion, 125° F.
DI spray rinse, 15 seconds, ambient temperature;
Warm air blowoff until dry Example 1

A zinc phosphate activator rinse was prepared by dispersing 2.6 g of Dispersion A into 3 liters of deionized water. The resultant rinse had a theoretical concentration of 0.5 grams per liter of dispersed zinc phosphate. This bath was used as the activator in the standard zinc phosphating process detailed above to produce phosphate coatings on 4"×6" panels of cold rolled steel (CRS) and electrogalvanized steel (EG).

Example 2

The dispersion of Example 1 was diluted with deionized water to 30% of its initial concentration, or 0.149 grams per liter of dispersed zinc phosphate. This bath was used as the activator in the standard zinc phosphating process to produce phosphate coatings on CRS and EG panels, as in Example 1. The EG panel had acceptable appearance, but the zinc phosphate coating on the CRS panel was incomplete and unacceptable.

Example 3

3 grams of Dispersion B were added to the dispersion of Example 2 and mixed in until homogeneous, to give a bath containing 0.149 grams per liter of zinc phosphate and 0.25 grams per liter of silica. This bath was used as the activator in the standard zinc phosphating process to produce phosphate coatings on CRS and EG panels. Both panels had complete phosphate coatings with good crystal refinement.

Example 4

3 grams of Dispersion B were mixed into 3 liters of deionized water to give a stable dispersion containing 0.25 grams per liter of silica. This bath was used as the activator in the standard zinc phosphating process to treat CRS, EG and aluminum panels (alloy 6111). The dispersion did not activate zinc phosphate coating; the CRS had virtually no crystals, and the EG and aluminum had extremely large and poorly refined crystals. All three substrates were unacceptable.

Example 5

0.54 grams of Dispersion A were added to the dispersion of Example 4 to give a dispersion containing 0.25 grams per liter of silica and 0.105 grams per liter of zinc phosphate. This bath was used as the activator in the standard zinc phosphating process to treat CRS, EG and aluminum panels. All three substrates had complete phosphate coatings with good crystal refinement.

Example 6

2.8 grams of Dispersion C were added into 3 liters of deionized water to give a dispersion containing 0.5 grams per liter of zinc phosphate. This bath was used as the activator in the standard zinc phosphating process to treat CRS, EG and aluminum panels. All three substrates had complete phosphate coatings with good crystal refinement.

Coating weights and crystal sizes for the phosphate coatings produced in Examples 1-6 are provided in Table 1, below.

TABLE 1

| Example | CRS Coating Weight (mg/ft$^2$) | CRS Crystal Size (μ) | EG Coating Weight (mg/ft$^2$) | EG Crystal Size (μ) | Aluminum Coating Weight (mg/ft$^2$) | Aluminum Crystal Size (μ) |
|---|---|---|---|---|---|---|
| 1 | 309 | 3.8 | 242 | 2.1 | — | — |
| 2 | 423 | 11* | 209 | 1.7 | — | — |
| 3 | 325 | 3.3 | 199 | 2.5 | — | — |
| 4 | 67 | Few large crystals* | 583 | ≥50 | 308 | ≥30* |
| 5 | 362 | 4.3 | 224 | 2.2 | 188 | 3.1 |
| 6 | 239 | 3.6 | 184 | 2.6 | 161 | 4.5 |

*Indicates incomplete coating

Example 7

A zinc phosphate rinse conditioner bath was prepared as described in Example 6, using dispersion C, and was aged as described below.

Comparative Example

As a comparative example, a conventional Jernstedt salt-based rinse conditioner bath was prepared by dissolving 3 grams of Rinse Conditioner, available from PPG Industries, Inc., in deionized water. A portion of the bath was tested as described above in Example 6 (i.e., "fresh") and a portion was aged, as described below.

The baths from Example 7 and the comparative example were allowed to sit in closed containers for eight weeks. After eight weeks, they were each used as activators in the standard zinc phosphating process as detailed above to phosphate panels made of cold rolled steel and galvanized steel. The crystal size and coating coverage were similar to the fresh bath (Example 6) for the Example 7 process, but the conventional material no longer activated after eight weeks. Crystal sizes appear in Table 2, below:

TABLE 2

| Activator | CRS Crystal Size (μ) | EG Crystal Size (μ) |
|---|---|---|
| Fresh (Example 6) | 3.6 | 2.6 |
| Fresh, Comparative | 1.8 | 3.2 |
| Aged (Example 7) | 2.4 | 2.1 |
| Aged, Comparative | Incomplete | 27 |

Whereas particular embodiments of this invention have been described above for purposes of illustration, it will be evident to those skilled in the art that numerous variations of the details of the present invention may be made without departing from the invention as defined in the appended claims.

We claim:

1. An activating rinse for treating a substrate comprising:

(a) a first component comprising a dispersion of phosphate particles of divalent or trivalent metals or combinations thereof, said metal phosphate particles having an average particle size that is not greater than 10 μm; and (b) a second component comprising:

(i) a first copolymer formed by the polymerization of ethylene oxide, propylene oxide, or combinations thereof, wherein one end of the first copolymer is terminated by an amine group, a hydroxyl group, or an alkyl group; and (ii) a second copolymer formed by the polymerization of styrene and a second monomer containing at least one carboxylate group, anhydride group, or combinations thereof, wherein the second monomer is present in an amount of less than 50 percent by weight of the total weight of the second component.

2. The activating rinse according to claim 1, wherein the metal phosphate is present in an amount from 50 to 5,000 ppm based on the total weight of the activating rinse.

3. The activating rinse according to claim 1, wherein the metal phosphate is present in an amount from 150 to 1,500 ppm based on the total weight of the activating rinse.

4. The activating rinse according to claim 1, wherein the divalent or trivalent metal comprises zinc, iron, or a combination thereof.

5. The activating rinse according to claim 1, wherein the first copolymer is present in amount from 10 ppm to 10,000 ppm based on the total weight of the activating rinse.

6. The activating rinse according to claim 1, wherein the first copolymer is present in amount from 50 ppm to 1,000 ppm based on the total weight of the activating rinse.

7. The activating rinse according to claim 1, wherein the second copolymer is present in an amount of less than 30 percent by weight of the total weight of the activating rinse.

8. The activating rinse according to claim 1, wherein the second monomer comprises a diacid, an anhydride of a diacid, or a combination thereof.

9. The activating rinse according to claim 1, wherein the weight ratio of the first component to the second component is from 1:1 to 20:1.

10. The activating rinse according to claim 1, further comprising silica.

11. The activating rinse according to claim 10, wherein the silica is present in an amount from 50 ppm to 5,000 ppm based on the total weight of the activating rinse.

12. The composition according to claim 10, wherein the silica is precipitated.

13. The composition according to claim 10, wherein the silica is friable under shear.

14. A method for treating a substrate comprising: (i) applying an activating rinse to at least a portion of the substrate, wherein the activating rinse comprises:

(a) a first component comprising a dispersion of phosphate particles of divalent or trivalent metals or combinations thereof, said metal phosphate particles having an average particle size that is not greater than 10 μm; and (b) a second component comprising:

(i) a first copolymer formed by the polymerization of ethylene oxide, propylene oxide, or combinations thereof, wherein one end of the first copolymer is terminated by an amine group, a hydroxyl group, or an alkyl group; and (ii) a second copolymer formed by the polymerization of styrene and a second monomer containing at least one carboxylate group, anhydride group, or combinations thereof, wherein the second monomer is present in an amount of less than 50 percent by weight of the total weight of the second component.

15. The method according to claim 14, wherein the divalent or trivalent metal comprises zinc, iron, or a combination thereof.

16. The method according to claim 14, wherein the second monomer comprises a diacid, an anhydride of a diacid, or a combination thereof.

17. The method according to claim 14, wherein the activating rinse further comprises silica.

18. The method according to claim 14, further comprising (ii) phosphatizing at least a portion of the substrate with a zinc phosphate solution.

19. A substrate treated with the activating rinse of claim 1.

20. The substrate of claim 19, further comprising a phosphate coating.

* * * * *